US009859642B2

(12) United States Patent
Hashiguchi

(10) Patent No.: US 9,859,642 B2
(45) Date of Patent: Jan. 2, 2018

(54) CONNECTOR AND METHOD FOR USING CONNECTOR

(71) Applicant: Japan Aviation Electronics Industry, Limited, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/591,874

(22) Filed: May 10, 2017

(65) Prior Publication Data

US 2017/0338579 A1 Nov. 23, 2017

(30) Foreign Application Priority Data

May 19, 2016 (JP) ..... 2016-100116

(51) Int. Cl.

| | |
|---|---|
| ***H01R 13/24*** | (2006.01) |
| ***H01R 13/627*** | (2006.01) |
| ***H01R 31/00*** | (2006.01) |
| ***H01R 4/06*** | (2006.01) |

(52) U.S. Cl.

CPC ..... *H01R 13/2457* (2013.01); *H01R 4/06* (2013.01); *H01R 13/627* (2013.01); *H01R 31/005* (2013.01)

(58) Field of Classification Search

CPC ..... A61B 5/0416; A61B 5/0408; H01R 2201/12; H01R 13/2457

USPC ..... 439/909, 37, 131, 132

See application file for complete search history.

(56) References Cited

U.S. PATENT DOCUMENTS

| | | | | |
|---|---|---|---|---|
| 1,167,780 A * | 1/1916 | Moses | H01R 11/282 | 24/115 G |
| 3,728,669 A * | 4/1973 | Churla | H01R 11/12 | 24/662 |
| 3,740,703 A * | 6/1973 | Sessions | H01R 11/22 | 24/649 |
| 4,206,960 A * | 6/1980 | Tantillo | H01R 11/22 | 439/269.1 |
| 4,303,293 A * | 12/1981 | Grunwald | A61B 5/0416 | 439/263 |

(Continued)

FOREIGN PATENT DOCUMENTS

JP 2015-135723 7/2015

*Primary Examiner* — Ross Gushi

(74) *Attorney, Agent, or Firm* — Muncy, Geissler, Olds & Lowe, P.C.

(57) ABSTRACT

A connector includes a first connector portion having a first contact point extending in a fitting direction and a second connector portion having a curved surface capable of inverting between a convex surface and a concave surface and a second contact point extending from the curved surface, the second contact point moving between a non-contacting position and a contacting position through inversion of the curved surface between the convex surface and the concave surface, the first connector portion being aligned with the second connector portion, with the second contact point being located at the non-contacting position, and the curved surface of the second connector portion being inverted so that the second contact point is switched to the contacting position, whereby the second contact point comes into contact with the first contact point to establish electrical connection between the first connector portion and the second connector portion.

13 Claims, 7 Drawing Sheets

(56) References Cited

U.S. PATENT DOCUMENTS 4,490,005 A * 12/1984 Hovey ..... A61B 5/0408 439/592
4,635,642 A * 1/1987 Cartmell ..... A61B 5/04087 600/392
4,674,817 A * 6/1987 Olms ..... H01R 11/24 439/592
4,676,561 A * 6/1987 Barrett, II ..... H01R 4/64 361/220
4,685,467 A * 8/1987 Cartmell ..... A61B 5/0408 439/86
4,842,557 A * 6/1989 Muz ..... A61B 5/0416 439/736
4,945,911 A * 8/1990 Cohen ..... A61B 5/0408 600/391
4,974,594 A * 12/1990 Berlin ..... A61B 5/0408 439/258
5,232,383 A * 8/1993 Barnick ..... A61N 1/048 439/855
5,261,402 A * 11/1993 Disabito ..... A61B 5/0408 600/392
5,326,272 A * 7/1994 Harhen ..... A61B 5/0416 439/859
5,427,096 A * 6/1995 Bogusiewicz ..... A61B 5/0416 600/394
5,499,628 A * 3/1996 Wright ..... A61B 5/0408 600/385
5,791,944 A * 8/1998 Grant ..... A61B 5/0416 439/822
5,895,298 A * 4/1999 Faupel ..... A61B 5/0416 439/729
5,897,406 A * 4/1999 Benes ..... H01R 11/22 439/859
6,064,901 A * 5/2000 Cartmell ..... A61B 5/04087 439/909
6,076,002 A * 6/2000 Cartmell ..... A61B 5/04087 156/267
6,223,088 B1 * 4/2001 Scharnberg ..... A61N 1/046 439/909
6,276,054 B1 * 8/2001 Cartmell ..... A61B 5/0408 156/252
6,319,015 B1 * 11/2001 Faunce ..... H01R 11/22 24/662
6,487,430 B1 * 11/2002 Henderson ..... A61B 5/0416 439/909
6,527,571 B2 * 3/2003 Muta ..... H01R 4/4809 439/246
6,636,754 B1 * 10/2003 Baura ..... A61B 5/02028 600/372
6,695,629 B1 * 2/2004 Mayer ..... H05K 7/142 361/752
6,711,427 B1 * 3/2004 Ketelhohn ..... A61B 5/04025 600/372
6,716,070 B2 * 4/2004 Christensson ..... A61N 1/02 439/729
6,780,065 B2 * 8/2004 Schwarz ..... A61N 1/048 439/310
6,950,688 B2 * 9/2005 Axelgaard ..... A61B 5/04087 600/391
7,214,107 B2 * 5/2007 Powell ..... H01R 11/22 439/729
7,215,989 B1 * 5/2007 Burks ..... A61B 5/04085 600/391
7,245,957 B2 * 7/2007 Rowe ..... A61B 5/0408 600/391
7,255,609 B1 * 8/2007 Epstein ..... H01R 24/20 439/729
7,270,580 B2 * 9/2007 Bradley ..... A61B 5/04087 439/729
7,364,440 B2 * 4/2008 Gobron ..... H01R 13/025 439/77
7,445,522 B2 * 11/2008 Burnes ..... A61B 5/04085 439/725
7,574,262 B2 * 8/2009 Haugland ..... A61N 1/02 607/49
7,749,013 B2 * 7/2010 Sato ..... A61B 5/0408 439/281
7,819,710 B2 * 10/2010 McIntire ..... A61B 5/0416 439/890
7,892,017 B2 * 2/2011 Meyer ..... H01R 4/4845 439/435
7,950,971 B2 * 5/2011 Hobet ..... A61B 5/0408 439/822
8,123,568 B2 * 2/2012 Meyer ..... H01R 4/4845 439/668
8,197,276 B2 * 6/2012 Egloff ..... A61N 1/048 439/268
8,251,736 B2 * 8/2012 McIntire ..... A61B 5/0416 439/357
8,382,531 B2 * 2/2013 Astola ..... A61B 5/0416 439/733.1
8,406,843 B2 * 3/2013 Tiegs ..... A61B 5/0416 600/391
8,738,112 B2 * 5/2014 Choe ..... A61B 5/04085 600/391
8,814,574 B2 * 8/2014 Selby ..... H01R 4/4854 439/346
8,821,176 B2 * 9/2014 Egloff ..... A61N 1/048 439/268
8,868,216 B2 * 10/2014 Dunagan ..... A61B 5/0408 607/149
9,055,879 B2 * 6/2015 Selby ..... H01R 13/11
9,072,912 B2 * 7/2015 Hoyer ..... A61N 1/36003
9,166,304 B2 * 10/2015 D'Hiver ..... A61N 1/3752
9,226,680 B1 * 1/2016 Kendricks ..... A61B 5/0416
9,356,393 B2 * 5/2016 Egloff ..... A61N 1/048
9,408,547 B2 * 8/2016 Zhou ..... A61B 5/0416
9,510,649 B1 * 12/2016 Liu ..... A44B 17/0064
9,737,226 B2 * 8/2017 Zhou ..... A61B 5/0416
2004/0072475 A1 * 4/2004 Istvan ..... A61N 1/048 439/860
2006/0068649 A1 * 3/2006 Silber ..... A61B 5/04085 439/835
2007/0118031 A1 * 5/2007 Silber ..... A61B 5/053 600/393
2014/0275927 A1 * 9/2014 Simpson ..... A61B 5/0408 600/382
2016/0073701 A1 * 3/2016 Maloney ..... A41D 1/005 439/37
2016/0181729 A1 * 6/2016 Barth ..... A41D 1/005 439/37

* cited by examiner

CONNECTOR AND METHOD FOR USING CONNECTOR

BACKGROUND OF THE INVENTION

The present invention relates to a connector, and particularly to a connector serving for attachment and detachment of a wearable device.

In addition, the invention relates to a method for using a connector.

In recent years, so-called wearable devices, in which terminal devices such as various sensors and communication devices operate as being worn by a user, have attracted attention. Such a wearable device is electrically connected to a device like a measuring device or a power source to be used to transmit detected information or to receive power supply. While the electrical connection can be established via a connector attached to a garment, the connection via a connector has to be canceled, for example, when the wearable device is removed and when the garment is washed.

Accordingly, as disclosed in JP 2015-135723 A, a snap button connector has been used to establish connection between devices.

As illustrated in FIG. 26, a snap button connector disclosed in JP 2015-135723 A includes a male snap button 2 attached to a first cloth 1 and a female snap button 4 attached to a second cloth 3. The first cloth 1 and the second cloth 3 are made from conductive cloth, while the male snap button 2 and the female snap button 4 are formed of a conductive material. As a convex portion 5 of the male snap button 2 is inserted into a concave portion 6 of the female snap button 4 and pressed down by two bar-like springs 7 of the female snap button 4, the male snap button 2 and the female snap button 4 are electrically connected, whereby the first cloth 1 and the second cloth 3 are electrically connected via the male snap button 2 and the female snap button 4.

Electrical connection of the wearable device can be made using a snap button connector of this type, and when the wearable device is removed or the garment is washed, for example, the electrical connection via the snap button connector can be canceled by detachment of the male snap button 2 from the female snap button 4.

When the snap button connector of JP 2015-135723 A is used, however, the male snap button 2 needs to be strongly pressed toward the female snap button 4 with a force that counteracts an elastic force of the bar-like springs 7 for connection of the wearable device, while the male snap button 2 needs to be strongly pulled out from the female snap button 4 with a force that counteracts the elastic force of the bar-like springs 7 for removal of the wearable device; it has been a problem that the wearable device cannot be easily connected or removed.

SUMMARY OF THE INVENTION

The present invention has been made in order to solve the conventional problem described above and is aimed at providing a connector that serves for easy connection and removal of a wearable device.

In addition, the present invention is aimed at providing a method for using such a connector.

In a connector according to the present invention, a first connector portion and a second connector portion are fitted with each other in a fitting direction, wherein the first connector portion includes a first contact point extending in the fitting direction, wherein the second connector portion includes a curved surface capable of inverting between a convex surface projecting in the fitting direction and a concave surface sinking with reference to the fitting direction, and a second contact point extending from the curved surface, wherein the second contact point moves between a non-contacting position and a contacting position through inversion of the curved surface between the convex surface and the concave surface, and wherein the first connector portion is aligned with the second connector portion, with the second contact point of the second connector portion being located at the non-contacting position, and the curved surface of the second connector portion is inverted so that the second contact point is switched to the contacting position, whereby the second contact point of the second connector portion comes into contact with the first contact point of the first connector portion to establish electrical connection between the first connector portion and the second connector portion.

A method for using the connector according to the present invention comprises the steps of:

arranging a plurality of the second connector portions such that fitting directions thereof are aligned in a same direction and moving directions of positions of second contact points between the non-contacting position and the contacting position are aligned in a same direction; and arranging a plurality of the first connector portions in accordance with arrangement of the plurality of second connector portions.

DETAILED DESCRIPTION OF THE INVENTION

Embodiments of the present invention are described below based on the appended drawings.

Embodiment 1

Figure 1:
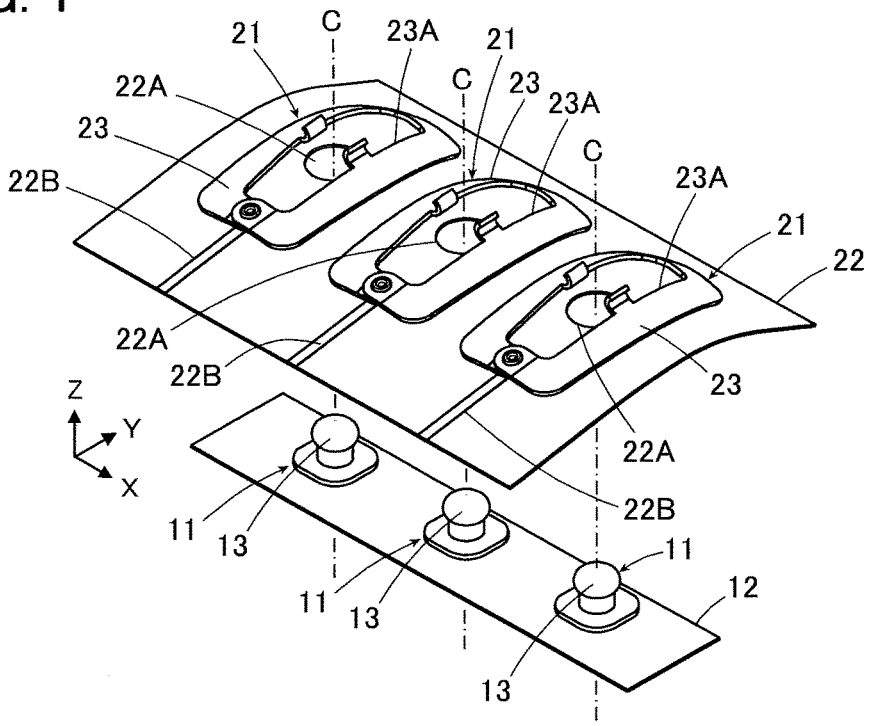
FIG. 1 is a perspective view showing a connector according to Embodiment 1 before fitting.

FIG. 1 shows a structure of a connector according to Embodiment 1. The connector includes a plurality of first connector portions 11 and a plurality of second connector portions 21, which are fitted with each other in a fitting direction along a plurality of fitting axes C that are parallel to one another.

The first connector portions 11 are linearly arranged at a given arrangement pitch and fixed on a front surface of a first base portion 12 in a flat plate shape, and each of the first connector portions 11 includes a convex portion 13 projecting in the fitting direction. On a rear surface of the first base portion 12, a plurality of wiring lines (not shown) are provided, to which the first connector portions 11 are respectively connected.

Meanwhile, the second connector portions 21 are linearly arranged at the same arrangement pitch as that of the first connector portions 11 and fixed on a front surface of a second base portion 22 in a sheet-like shape, and each of the second connector portions 21 includes a plate spring 23 having a substantially rectangular outer shape at the center of which an opening portion 23A is formed.

The second base portion 22 is provided with a plurality of through holes 22A each of which is located inside the opening portion 23A of the plate spring 23 of the corresponding second connector portion 21. Each of the through holes 22A is sized so as to allow the convex portion 13 of the first connector portion 11 to pass through it. On the front surface of the second base portion 22, a plurality of wiring lines 22B corresponding to the second connector portions 21 are provided, to which the second connector portions 21 are respectively connected.

For convenience, a direction from the first connector portion 11 toward the second connector portion 21 along the fitting axis C is defined as "+Z direction," a direction along which the plurality of first connector portions 11 and the plurality of second connector portions 21 are arranged is defined as "X direction," and a direction perpendicular to the XZ plane is defined as "Y direction".

The plate spring 23 of each of the second connector portions 21 has a substantially rectangular outer shape with a short side extending in the X direction and a long side extending in the Y direction.

Figure 2:
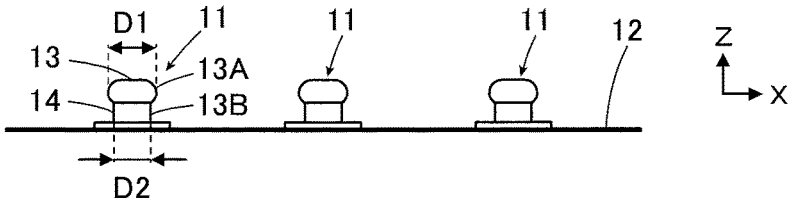
FIG. 2 is a front view showing first connector portions of the connector according to Embodiment 1.

The first connector portion 11 is formed of a conductive metal material, and, as illustrated in FIG. 2, the convex portion 13 of the first connector portion 11 projects from the first base portion 12 in the +Z direction, i.e., the fitting direction and has an overhanging portion 13A at a tip end thereof in the +Z direction. The overhanging portion 13A has an outside diameter D1 larger than an outside diameter D2 of a root portion 13B adjacent to the front surface of the first base portion 12 and overhangs in a radial direction farther away from the root portion 13B. An outer peripheral surface of the convex portion 13 as described above constitutes a first contact point 14 extending in the fitting direction.

Figure 3:
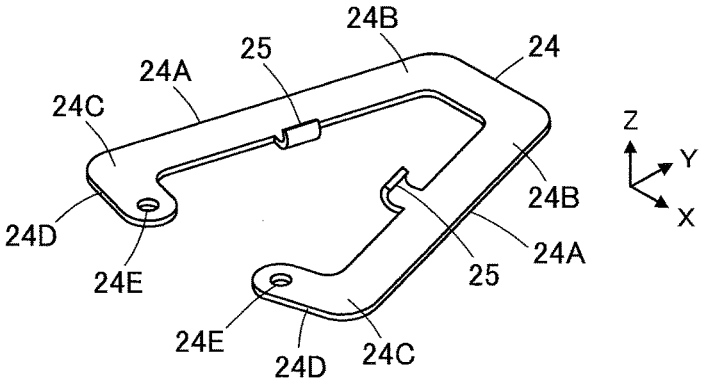
FIG. 3 is a perspective view showing a flat plate member used for a second connector portion of the connector according to Embodiment 1.
Figure 4:
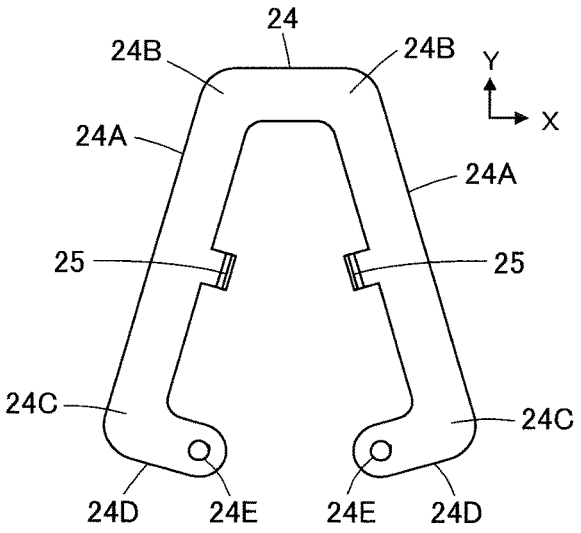
FIG. 4 is a plan view showing the flat plate member used for the second connector portion of the connector according to Embodiment 1.

Meanwhile, the plate spring 23 of the second connector portion 21 is produced using a flat plate member 24 as illustrated in FIGS. 3 and 4. The flat plate member 24 is formed of a conductive metal material and has a pair of arm portions 24A that face each other. The pair of arm portions 24A extend obliquely with respect to each other such that the distance therebetween becomes larger from one end portions 24B toward the other end portions 24C, while the one end portions 24B of the pair of arm portions 24A are adjacent to each other and joined together. The other end portions 24C of the pair of arm portions 24A are apart from each other and are respectively provided with bent portions 24D bending so as to approach each other, and each of the bent portions 24D is provided, at an end thereof, with a fixing hole 24E.

The flat plate member 24 is provided with a pair of second contact points 25 each having a cantilever shape, which pair of second contact points 25 project respectively from opposing side edges of the pair of arm portions 24A and extend so as to come closer to each other and bend to extend in the +Z direction. Each of the second contact points 25 is disposed at a central portion of the corresponding arm portion 24A in the longitudinal direction thereof.

Figure 5:
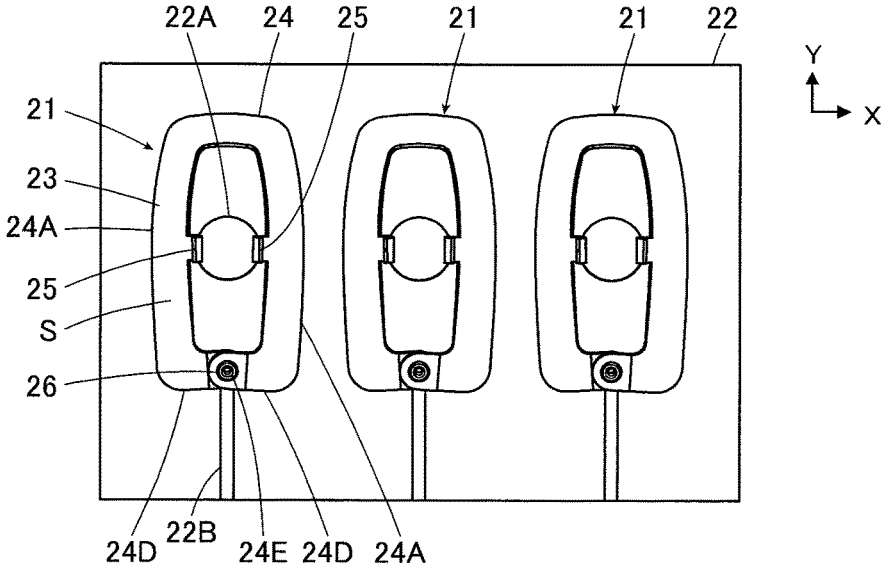
FIG. 5 is a plan view showing second connector portions of the connector according to Embodiment 1.

As illustrated in FIG. 5, with the flat plate member 24 being curved such that ends of the bent portions 24D of the arm portions 24A come into contact with each other and that the pair of fixing holes 24E are superimposed, a grommet 26 penetrates the pair of fixing holes 24E to fix the ends of the bent portions 24D together, whereby a plate spring 23 having a substantially rectangular outer shape can be produced.

A fixing member to fix the ends of the pair of bent portions 24D together is not limited to the grommet 26. For example, a screw may be used to fix the ends, or the ends of the pair of bent portions 24D may be deformed to be fixed through so-called caulking.

With the pair of second contact points 25 of the thus-produced plate spring 23 being aligned with the corresponding through hole 22A of the second base portion 22, each of the second contact portions 21 is fixed to the second base portion 22.

Figure 6:
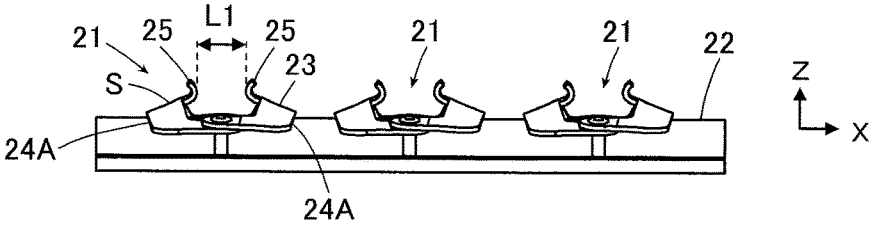
FIG. 6 is a front view showing the second connector portions of the connector according to Embodiment 1.
Figure 7:
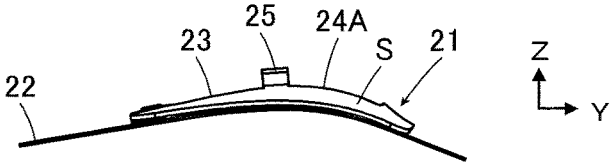
FIG. 7 is a side view showing the second connector portion of the connector according to Embodiment 1.

A surface of the curved flat plate member 24 of the plate spring 23 constitutes a curved surface S. As illustrated in FIGS. 6 and 7, the curved surface S forms a convex surface projecting in the +Z direction, i.e., the fitting direction, as seen along both the Y direction and the X direction and is warped in such a manner that a periphery of the substantially-rectangular plate spring 23 is located farther in the −Z direction than the opening portion 23A at the central portion of the plate spring 23, thereby maintaining a dynamically stable state. Meanwhile, when an external force in the +Z direction is applied to the periphery of the plate spring 23 in relation to the opening portion 23A at the central portion of the plate spring 23 so that the plate spring 23 is deformed, the curved surface S forms a concave surface sinking with reference to the +Z direction and becomes dynamically stable. That is, the curved surface S is configured to be invertible between a convex surface projecting in the fitting direction and a concave surface sinking with reference to the fitting direction.

As illustrated in FIG. 6, when the curved surface S forms a convex surface projecting in the +Z direction, the pair of second contact points 25 each in a cantilever shape and respectively disposed at opposing side edges of the pair of arm portions 24A are relatively apart from each other, and a distance L1 between the pair of second contact points 25 in the X direction is substantially equal to or larger than the outside diameter D1 of the overhanging portion 13A of the convex portion 13 of the first connector portion 11. At this time, a position where each of the second contact points 25 is located is called "non-contacting position."

On the contrary, when the curved surface S is inverted to form a concave surface sinking with reference to the +Z direction, the pair of second contact points 25 each in a cantilever shape and respectively disposed at opposing side edges of the pair of arm portions 24A are relatively close to each other, and a distance between the pair of second contact points 25 in the X direction is designed to be smaller than the outside diameter D2 of the root portion 13B of the convex portion 13 of the first connector portion 11. At this time, a position where each of the second contact points 25 is located is called "contacting position."

That is, the second contact point 25 moves between the non-contacting position and the contacting position in accordance with inversion of the curved surface S.

The first base portion 12 to which the plurality of first connector portions 11 are fixed may be a part of a housing of a circuit module connected to a wearable device (not shown) attached to a garment, for example.

In the meantime, the second base portion 22 to which the plurality of second connector portions 21 are fixed may be cloth of a garment to which a wearable device is attached, for example. In this case, the plate spring 23 is provided with a cut at the periphery thereof to form a lance portion, and the lance portion is deformed as holding the cloth of the garment therein, whereby the second connector portion 21 can be attached to the cloth as the second base portion 22. In addition, a thread for handicrafts may be used to sew the second connector portion 21 to the cloth as the second base portion 22. Moreover, the second connector portion 21 may be directly sewed to the corresponding wire line 22B of the second base portion 22 using a conductive thread.

Figure 8:
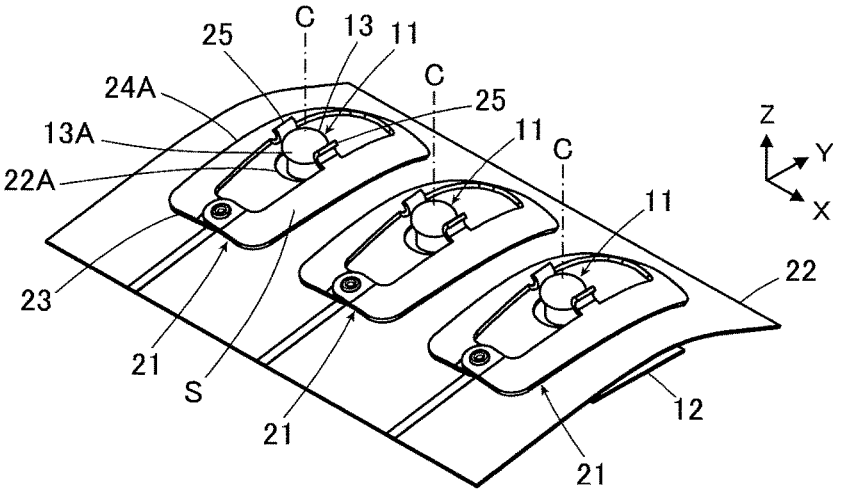
FIG. 8 is a perspective view showing the first connector portions and the second connector portions of the connector according to Embodiment 1 as being aligned with each other.

For fitting the first connector portions 11 with the second connector portions 21, as illustrated in FIG. 8, firstly, the convex portions 13 of the plurality of first connector portions 11 are inserted respectively in the plurality of through holes 22A of the second base portion 22 from the −Z direction, with the curved surfaces S of the plate springs 23 of the second connector portions 21 each forming a convex surface projecting in the +Z direction and the second contact points 25 of the pairs of arm portions 24A each being located at the non-contacting position.

Figure 9:
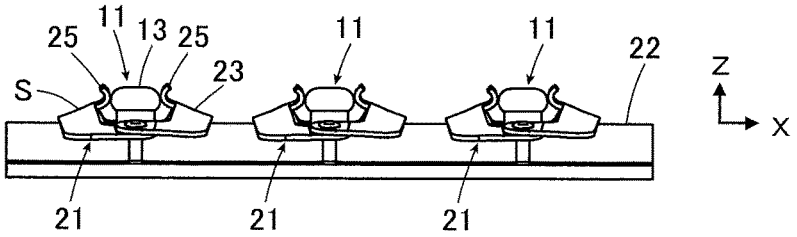
FIG. 9 is a front view showing the first connector portions and the second connector portions of the connector according to Embodiment 1 as being aligned with each other.
Figure 10:
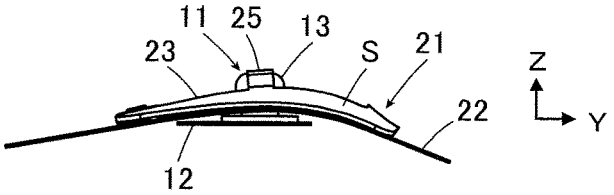
FIG. 10 is a side view showing the first connector portion and the second connector portion of the connector according to Embodiment 1 as being aligned with each other.

In this process, since the pair of second contact points 25 of each of the second connector portions 21 are located at the non-contacting position, the pair of second contact points 25 are apart from each other in the X direction by the distance L1 that is substantially same as or larger than the outside diameter D1 of the overhanging portion 13A of the convex portion 13 of the corresponding first connector portion 11, as illustrated in FIG. 6. Accordingly, the convex portion 13 of each of the first connector portions 11 that passed through the corresponding through hole 22A of the second base portion 22 can be readily inserted between the second contact points 25 of the pair of arm portions 24A of the corresponding second connector portion 21 as illustrated in FIGS. 9 and 10 without the need for a force that counteracts the elastic force of the plate spring 23, whereby the first connector portions 11 and the second connector portions 21 are aligned with each other.

Figure 11:
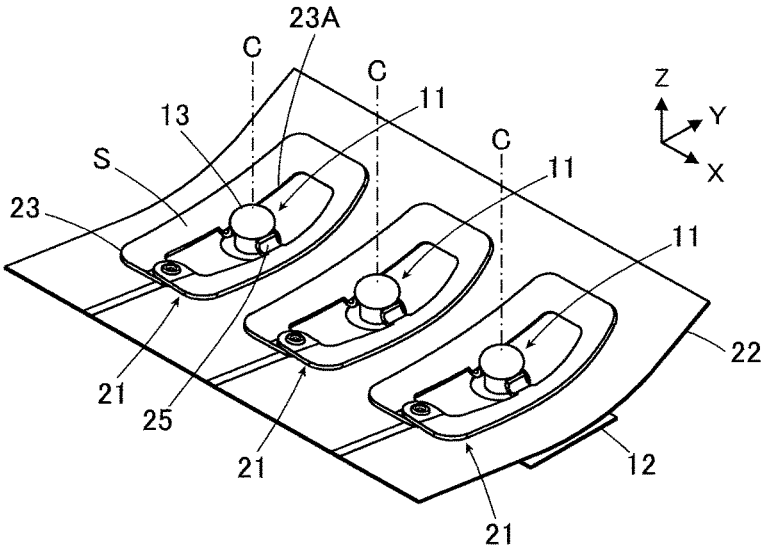
FIG. 11 is a perspective view showing the connector according to Embodiment 1 at a time of fitting.

Next, as illustrated in FIG. 11, the plate spring 23 of each of the second connector portions 21 is deformed by an external force applied to the periphery of the plate spring 23 in the +Z direction in relation to the opening portion 23A at the central portion of the plate spring 23, whereby the curved surface S forming a convex surface projecting in the +Z direction is inverted to a concave surface sinking with reference to the +Z direction.

Since the curved surface S is inverted and forms a concave surface sinking with reference to the +Z direction, the pair of second contact points 25 of each of the second connector portions 21 are switched from the non-contacting position to the contacting position, and the distance between the pair of second contact points 25 in the X direction becomes smaller. As a result, the pair of second contact points 25 of each of the second connector portions 21 sandwich the convex portion 13 of the corresponding first connector portion 11 at the outer peripheral surface of the convex portion 13 so as to come into contact with the first contact point 14 formed on the outer peripheral surface of the convex portion 13 and establish electrical connection therebetween, whereby the first connector portion 11 and the corresponding second connector portion 21 are fitted with each other.

Figure 12:
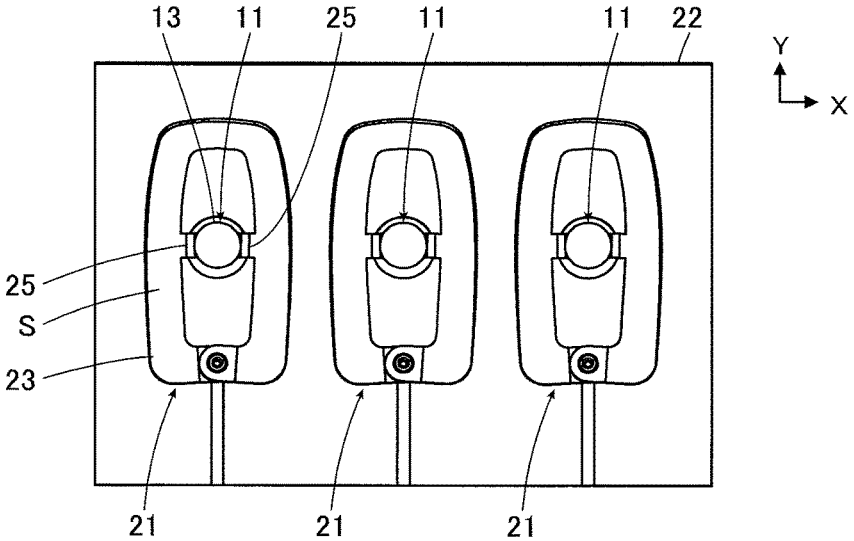
FIG. 12 is a plan view showing the connector according to Embodiment 1 at the time of fitting.
Figure 13:
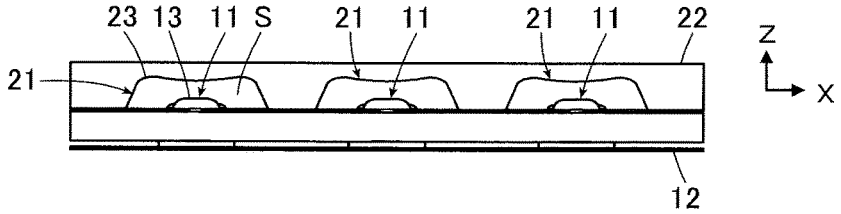
FIG. 13 is a front view showing the connector according to Embodiment 1 at the time of fitting.
Figure 14:
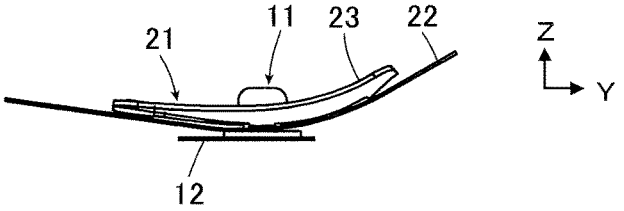
FIG. 14 is a side view showing the connector according to Embodiment 1 at the time of fitting.

Illustrated in FIGS. 12 to 14 are the plurality of first connector portions 11 and the plurality of second connector portions 21 that are fitted with each other in this manner.

Figure 15:
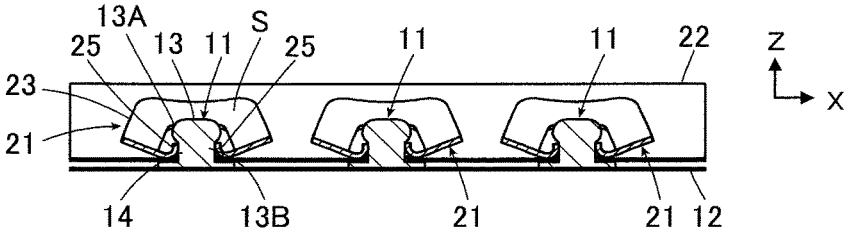
FIG. 15 is a cross-sectional view showing the connector according to Embodiment 1 at the time of fitting.

When the first connector portions 11 and the second connector portions 21 are fitted, the second contact points 25 of the second connector portions 21 are each located at the contacting position, and the distance between each pair of second contact points 25 in the X direction is smaller than the outside diameter D2 of the root portion 13B of the convex portion 13 of the corresponding first connector portions 11. As illustrated in FIG. 15, the pair of second contact points 25 of each of the second connector portions 21 come into elastic contact with the first contact point 14 while being located between the overhanging portion 13A and the root portion 13B of the convex portion 13 of the corresponding first connector portion 11.

Accordingly, even if the fitted first connector portions 11 and second connector portions 21 are applied with an external force to draw them away from each other, the pairs of second contact points 25 of the second connector portions 21 are caught by the overhanging portions 13A of the convex portions 13 of the first connector portions 11 so that the fitted first connector portions 11 and second connector portions 21 would not readily fall off from each other, and the reliable electrical connection is established.

Fitting between the first connector portions 11 and the second connector portions 21 can be canceled through withdrawal of the first connector portions 11 from the second connector portions 21, with the plate spring 23 of each of the second connector portions 21 being deformed by an external force applied to the periphery of the plate spring 23 in the −Z direction in relation to the opening portion 23A at the central portion of the plate spring 23 so that the curved surface S forming a concave surface sinking with reference to the +Z direction is inverted to a convex surface projecting in the +Z direction.

In this process, due to inversion of the curved surface S of each of the second connector portions 21 into a convex surface projecting in the +Z direction, the pair of second contact points 25 move to the non-contacting position, allowing the convex portion 13 of the first connector portion 11 to be pulled out from between the second contact points 25 of the pair of arm portions 24A of the corresponding second connector portion 21 without the need for a force that counteracts the elastic force of the plate spring 23.

Accordingly, a connector requiring no large force both for fitting the first connector portions 11 with the second connector portions 21 and for canceling the fitting therebetween and having an excellent operability can be realized, and a wearable device can be easily connected and removed by means of the connector.

The plurality of second connector portions 21 are linearly arranged on the front surface of the sheet-like second base portion 22 such that fitting directions thereof are aligned in the same Z direction and that moving directions of the positions of the second contact points 25 between the non-contacting position and the contacting position are aligned in the same X direction, while the plurality of first connector portions 11 are arranged in accordance with the arrangement of the plurality of second connector portions 21. Hence, it is possible to, for example, place a finger across the plurality of second connector portions 21 and deform the plurality of second connector portions 21 at a time to invert the curved surfaces S of the second connector portions 21 at once between a convex surface projecting in the +Z direction and a concave surface sinking with reference to the +Z direction. Accordingly, the plurality of first connector portions 11 and the plurality of second connector portions 21 can be readily fitted or released by a single operation.

The plurality of second connector portions 21 may be connected to one another; in that case, it becomes possible to easily deform the second connector portions 21 at a time to invert the respective curved surfaces S at once.

In Embodiment 1 as illustrated in FIGS. 1 to 15, the connector has three first connector portions 11 and three second connector portions 21 to be fitted with each other. However, this is not the sole case, and the connector may be configured such that one first connector portion 11 is fitted with one second connector portion 21. Similarly, the connector may be configured such that two first connector portions 11 are fitted with two second connector portions 21, or four or more first connector portions 11 are fitted with four or more second connector portions 21.

Embodiment 2

Figure 16:
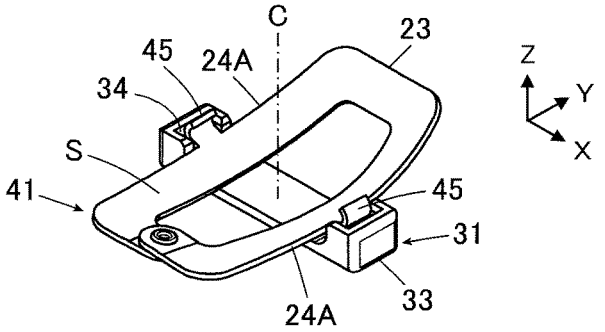
FIG. 16 is a perspective view showing a connector according to Embodiment 2 before fitting.
Figure 17:
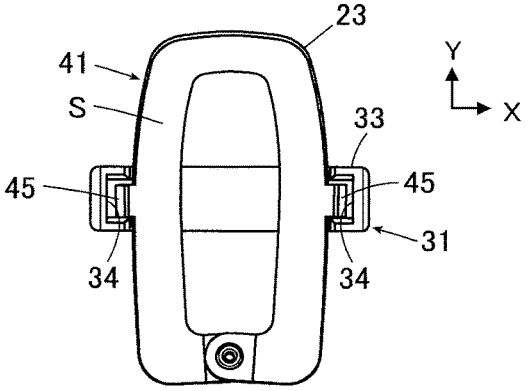
FIG. 17 is a plan view showing a first connector portion and a second connector portion of the connector according to Embodiment 2 as being aligned with each other.
Figure 18:
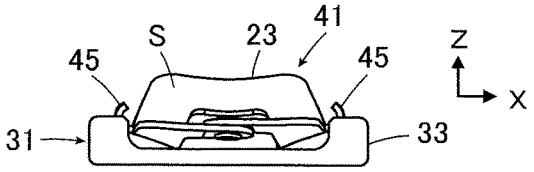
FIG. 18 is a front view showing the first connector portion and the second connector portion of the connector according to Embodiment 2 as being aligned with each other.
Figure 19:
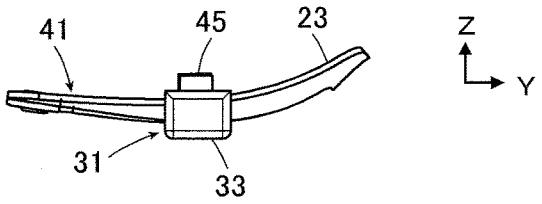
FIG. 19 is a side view showing the first connector portion and the second connector portion of the connector according to Embodiment 2 as being aligned with each other.

FIG. 16 shows a structure of a connector according to Embodiment 2. The connector includes a first connector portion 31 and a second connector portion 41, which are fitted with each other in a fitting direction along a fitting axis C.

The second connector portion 41 includes a plate spring 23 similar to that of the second connector portion 21 in Embodiment 1 and a pair of second contact points 45 each having a cantilever shape, which pair of second contact points 45 respectively extend from opposite side edges of a pair of arm portions 24A of the plate spring 23 so as to separate from each other and bend to extend in the +Z direction. In other words, the second connector portion 41 is provided with the pair of second contact points 45 formed at and projecting from the opposite side edges of the pair of arm portions 24A, in place of the pair of second contact points 25 formed at and projecting from opposing side edges of the pair of arm portions 24A in the second connector portion 21 in Embodiment 1.

Each of the pair of second contact points 45 is disposed at a central portion of the corresponding arm portion 24A in the longitudinal direction thereof.

In the meantime, a first connector portion 31 includes a second connector portion-accommodation portion 33 that extends in the X direction and accommodates the pair of second contact points 45 of the second connector portion 41. The second connector portion-accommodation portion 33 has, at both end portions thereof in the X direction, inner walls that oppose each other and each extend along the YZ plane, and each of the inner walls constitutes a first contact point 34.

FIGS. 16 to 19 illustrate a state where a curved surface S of the plate spring 23 of the second connector portion 41 forms a concave surface sinking with reference to the +Z direction and where the pair of second contact points 45 of the second connector portion 41 are accommodated in the second connector portion-accommodation portion 33 of the first connector portion 31. The pair of inner walls of the first connector portion 31 each face the corresponding second contact point 45 of the second connector portion 41.

Figure 20:
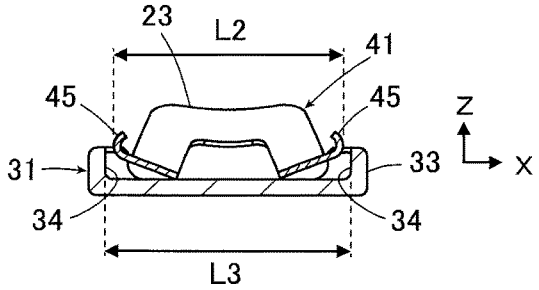
FIG. 20 is a cross-sectional view showing the first connector portion and the second connector portion of the connector according to Embodiment 2 as being aligned with each other.
Figure 21:
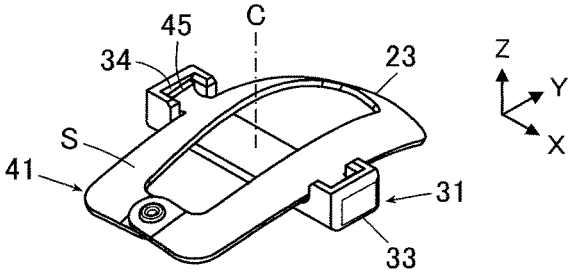
FIG. 21 is a perspective view showing the connector according to Embodiment 2 at a time of fitting.
Figure 22:
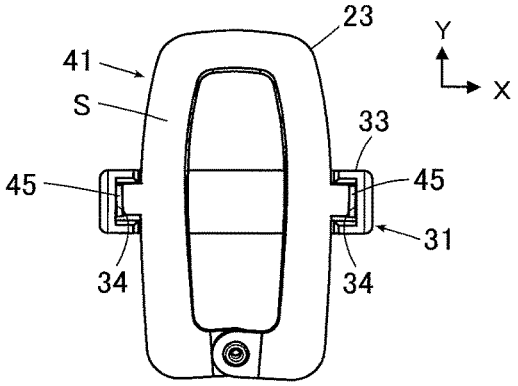
FIG. 22 is a plan view showing the connector according to Embodiment 2 at the time of fitting.
Figure 23:
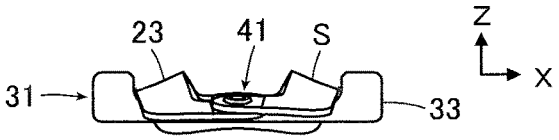
FIG. 23 is a front view showing the connector according to Embodiment 2 at the time of fitting.
Figure 24:
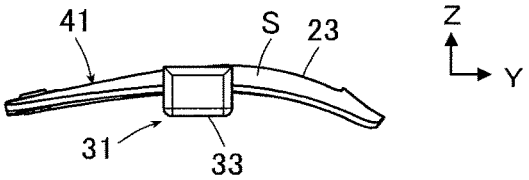
FIG. 24 is a side view showing the connector according to Embodiment 2 at the time of fitting.

When the curved surface S of the plate spring 23 forms a concave surface sinking with reference to the +Z direction as described above, the pair of second contact points 45 each in a cantilever shape and respectively disposed at opposite side edges of the pair of arm portions 24A of the plate spring 23 are relatively close to each other, and as illustrated in FIG. 20, a distance L2 between the pair of second contact points 45 in the X direction is substantially equal to or smaller than a distance L3 between the pair of first contact points 34 of the first connector portion 31 in the X direction. At this time, a position where each of the second contact points 45 is located is called "non-contacting position."

On the contrary, when the curved surface S is inverted and forms a convex surface projecting in the +Z direction, the pair of second contact points 45 each in a cantilever shape and respectively disposed at opposite side edges of the pair of arm portions 24A are relatively apart from each other, and a distance between the pair of second contact points 45 in the X direction is designed to be larger than the distance L3 between the pair of first contact points 34 of the first connector portion 31 in the X direction. At this time, a position where each of the second contact points 45 is located is called "contacting position."

That is, the second contact point 45 moves between the non-contacting position and the contacting position in accordance with inversion of the curved surface S.

For fitting the first connector portion 31 with the second connector portion 41, as illustrated in FIGS. 16 to 19, firstly, the first connector portion 31 and the second connector portion 41 are aligned with each other, and the pair of second contact points 45 of the second connector portion 41 are accommodated in the second connector portion-accommodation portion 33 of the first connector portion 31, with the curved surface S of the plate spring 23 of the second connector portion 41 forming a concave surface sinking with reference to the +Z direction and the pair of second contact points 45 each being located at the non-contacting position.

At this time, since the pair of second contact points 45 of the second connector portion 41 are located at the non-contacting position, the distance L2 between the pair of second contact points 45 in the X direction is substantially equal to or smaller than the distance L3 between the pair of first contact points 34 of the first connector portion 31 in the X direction, as illustrated in FIG. 20. Accordingly, the pair of second contact points 45 of the second connector portion 41 are easily accommodated in the second connector portion-accommodation portion 33 of the first connector portion 31 without the need for a force that counteracts the elastic force of the plate spring 23.

Next, as illustrated in FIGS. 21 to 24, the plate spring 23 of the second connector portion 41 is deformed such that the curved surface S forming a concave surface sinking with reference to the +Z direction is inverted to form a convex surface projecting in the +Z direction.

Figure 25:
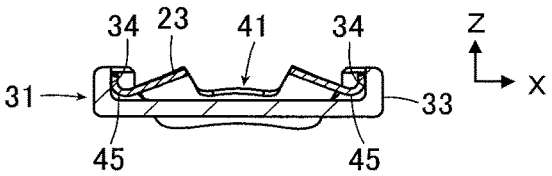
FIG. 25 is a cross-sectional view showing the connector according to Embodiment 2 at the time of fitting.
Figure 26:
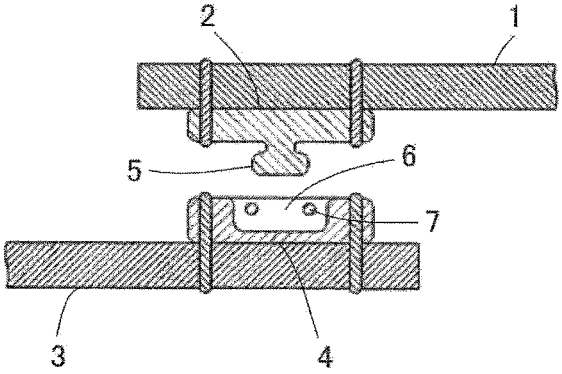
FIG. 26 PRIOR ART
FIG. 26 is a cross-sectional view showing a conventional connector.

Since the curved surface S is inverted and forms a convex surface projecting in the +Z direction, the positions of the pair of second contact points 45 of the second connector portion 41 are switched from the non-contacting position to the contacting position, and the distance between the pair of second contact points 45 in the X direction increases. Accordingly, as illustrated in FIG. 25, the pair of second contact points 45 of the second connector portion 41 respectively press the pair of inner walls of the first connector portion 31 toward the outside of the second connector portion-accommodation portion 33 to come into contact with the first contact points 34 and establish electrical connection therewith, whereby the first connector portion 31 and the second connector portion 41 are fitted with each other.

Fitting between the first connector portion 31 and the second connector portion 41 can be canceled through withdrawal of the first connector portion 31 from the second connector portion 41, with the plate spring 23 of the second connector portion 41 being deformed and the curved surface S being inverted from a convex surface projecting in the +Z direction to a concave surface sinking with reference to the +Z direction.

In this process, since the curved surface S of the second connector portion 41 is inverted and forms a concave surface sinking with reference to the +Z direction so that the pair of second contact points 45 move to the non-contacting position, the first connector portion 31 can be detached from the second connector portion 41 without the need for a force that counteracts the elastic force of the plate spring 23.

As described above, a connector requiring no large force both for fitting the first connector portion 31 with the second connector portion 41 and for canceling the fitting therebetween and having an excellent operability can be realized.

While one first connector portion 31 is fitted with one second connector portion 41 in the connector according to Embodiment 2, the connector may be configured so as to include a plurality of first connector portions 31 and a plurality of second connector portions 41 like in Embodiment 1.

In that case, the plurality of second connector portions 41 are linearly arranged on the front surface of the sheet-like second base portion such as cloth such that fitting directions thereof are aligned in the same Z direction and that moving directions of the second contact points 45 between the non-contacting position and the contacting position are aligned in the same X direction, while the plurality of first connector portions 31 are arranged in accordance with arrangement of the plurality of second connector portions 41; with this arrangement, the plurality of second connector portions 41 are deformed at a time so that the curved surfaces S of the plurality of second connector portions 41 can be inverted between the concave surface sinking with reference to the +Z direction and the convex surface projecting in the +Z direction at once. Accordingly, the plurality of first connector portions 31 and the plurality of second connector portions 41 can be readily fitted or released by a single operation.

In addition, when the connector includes the plurality of first connector portions 31 and the plurality of second connector portions 41, the plurality of second connector portions 41 may be joined together; with this constitution, when the plurality of second connector portions 41 are deformed at a time, their curved surfaces S can be readily inverted at once.

As described above, the operability can be improved also in the connector according to Embodiment 2, and a wearable device can be readily connected and removed by means of the connector.

What is claimed is:

1. A connector in which a first connector portion and a second connector portion are fitted with each other in a fitting direction, wherein the first connector portion includes a first contact point extending in the fitting direction, wherein the second connector portion includes a curved surface capable of inverting between a convex surface projecting in the fitting direction and a concave surface sinking with reference to the fitting direction, and a second contact point extending from the curved surface, wherein the second contact point moves between a non-contacting position and a contacting position through inversion of the curved surface between the convex surface and the concave surface, and wherein the first connector portion is aligned with the second connector portion, with the second contact point of the second connector portion being located at the non-contacting position, and the curved surface of the second connector portion is inverted so that the second contact point is switched to the contacting position, whereby the second contact point of the second connector portion comes into contact with the first contact point of the first connector portion to establish electrical connection between the first connector portion and the second connector portion.

2. The connector according to claim 1, wherein the second connector portion includes a plate spring that is composed of: a flat plate member having a pair of arm portions whose one-end portions are integrally joined together and whose other-end portions are apart from each other; and a fixing member for fixing the other-end portions of the pair of arm portions to each other, the other-end portions being in contact with each other due to curvature of the flat plate member.

3. The connector according to claim 2, wherein the first connector portion includes a convex portion that comes between the pair of arm portions at a time of fitting with the second connector portion and that projects in the fitting direction, and the first contact point is composed of an outer peripheral surface of the convex portion.

4. The connector according to claim 3, wherein the second connector portion includes a pair of the second contact points each of which has a cantilever shape and which extend from opposing side edges of the pair of arm portions, and wherein, when the first connector portion is fitted with the second connector portion, the pair of second contact points are each located at the contacting position and sandwich the outer peripheral surface of the convex portion, thereby coming into contact with the first contact point.

5. The connector according to claim 4, wherein each of the pair of second contact points is disposed at a central portion of a corresponding one of the pair of arm portions.

6. The connector according to claim 3, wherein the convex portion of the first connector portion has, at a tip end thereof in the fitting direction, an overhanging portion overhanging in a radial direction farther away from a root portion, and wherein, when the first connector portion is fitted with the second connector portion, the pair of second contact points are in elastic contact with the first contact point while being located between the root portion and the overhanging portion of the convex portion.

7. The connector according to claim 2, wherein the first connector portion includes a second connector portion-accommodation portion that accommodates at least the second contact point of the second connector portion and that has an inner wall that faces the second contact point, and the first contact point is composed of the inner wall of the second connector portion-accommodation portion.

8. The connector according to claim 7, wherein the second connector portion includes a pair of the second contact points each of which has a cantilever shape and which extend from side edges of the pair of arm portions, the side edges facing in opposite directions, wherein the second connector portion-accommodation portion of the first connector portion has a pair of the inner walls respectively facing the pair of second contact points, and wherein, when the first connector portion is fitted with the second connector portion, the pair of second contact points are each located at the contacting position and press the pair of inner walls toward an outside of the second connector portion-accommodation portion, thereby coming into contact with the first contact point.

9. The connector according to claim 8, wherein each of the pair of second contact points is disposed at a central portion of a corresponding one of the pair of arm portions.

10. The connector according to claim 1, wherein the second connector portion is fixed to cloth.

11. The connector according to claim 1, further comprising: a plurality of the first connector portions; and a plurality of the second connector portions to be respectively fitted with the plurality of first connector portions, wherein the plurality of second connector portions are arranged such that fitting directions thereof are aligned in a same direction and moving directions of positions of second contact points between the non-contacting position and the contacting position are aligned in a same direction, and wherein the plurality of first connector portions are arranged in accordance with arrangement of the plurality of second connector portions.

12. The connector according to claim 11, wherein the plurality of second connector portions are joined together.

13. A method for using the connector of claim 1, comprising the steps of:

arranging a plurality of the second connector portions such that fitting directions thereof are aligned in a same direction and moving directions of positions of second contact points between the non-contacting position and the contacting position are aligned in a same direction; and arranging a plurality of the first connector portions in accordance with arrangement of the plurality of second connector portions.

* * * * *